US006923624B2

(12) United States Patent
Tsai

(10) Patent No.: US 6,923,624 B2
(45) Date of Patent: Aug. 2, 2005

(54) WOODEN FAN BLADE

(76) Inventor: Ming-Tsai Tsai, No. 87, He Tsuo Street, San Tsun Li, Feng Yuan City, Taichung Hsien (TW)

( * ) Notice: Subject to any disclaimer, the term of this patent is extended or adjusted under 35 U.S.C. 154(b) by 43 days.

(21) Appl. No.: 10/718,714

(22) Filed: Nov. 24, 2003

(65) Prior Publication Data

US 2005/0111986 A1 May 26, 2005

(51) Int. Cl.[7] ..... F01D 5/14
(52) U.S. Cl. ..... 416/231 B; 416/210 R; 416/236 R
(58) Field of Search ..... 416/210 R, 224, 416/229 R, 230, 231 B, 236 B

(56) References Cited

U.S. PATENT DOCUMENTS 2,169,325 A * 8/1939 Novak ..... 244/198
5,403,160 A * 4/1995 You ..... 416/223 R
5,967,754 A * 10/1999 Chou ..... 416/210 R
D483,858 S * 12/2003 Lin ..... D23/413
D491,657 S * 6/2004 Cartwright ..... D23/413
2004/0047735 A1 * 3/2004 Cartwright ..... 416/229 R

* cited by examiner

*Primary Examiner*—Edward K. Look
*Assistant Examiner*—Igor Kershteyn
(74) *Attorney, Agent, or Firm*—Bacon & Thomas PLLC

(57) ABSTRACT

A wooden fan blade includes an elongated blade body and a rib strip fitted into the elongated blade body. The blade body is made of a wooden plate having wooden fibers extended substantially in parallel to a longitudinal axis of the blade body. The blade body has an elongated groove transversely disposed at one side thereof across the extending direction of the wooden fibers of the wooden plate. The rib strip is fitted into the elongated groove and has a plurality of raised portions respectively forced into engagement with the blade body in the elongated groove.

5 Claims, 4 Drawing Sheets

WOODEN FAN BLADE

BACKGROUND OF THE INVENTION

1. Field of the Invention

The present invention relates to fan blades and, more particularly, to a deformation-protective wooden fan blade.

2. Description of the Related Art

Regular fan blades for ceiling fans may be molded from hard plastics, or made of metal or wood. Wooden fan blades are most invited on the market for the advantage of the friendly quality of their wooden fiber pattern. In order to prevent curving of the blade body in longitudinal direction, a wooden fan blade has the wooden fibers extended substantially in parallel to the longitudinal axis of the blade body. However, this arrangement cannot prohibit the blade body from curving in transverse direction. Further, a wooden fan blade may break or split between fiber bundles due to a severe temperature or moisture change, causing the blade body to fall from the housing of the ceiling fan during rotary motion of the ceiling fan.

SUMMARY OF THE INVENTION

It is the primary objective of the present invention to provide a deformation-protective wooden fan blade, which has means to protect the fan blade body from curving and splitting.

To achieve this objective of the present invention, the wooden fan blade comprises a blade body and a rib strip fitted into the blade body. The blade body is made of a narrow, elongated flat wooden plate having wooden fibers extended substantially in parallel to a longitudinal axis of the blade body. The blade body has an elongated groove transversely disposed at one side thereof across the extending direction of the wooden fibers of the wooden plate. The rib strip is fitted into the elongated groove and has a plurality of raised portions respectively forced into engagement with the blade body in the elongated groove. The rib strip protects the blade body from deformation. The raised portions of the rib strip prevent breaking of the blade body between fiber bundles.

DETAILED DESCRIPTION OF THE INVENTION

Figure 1:
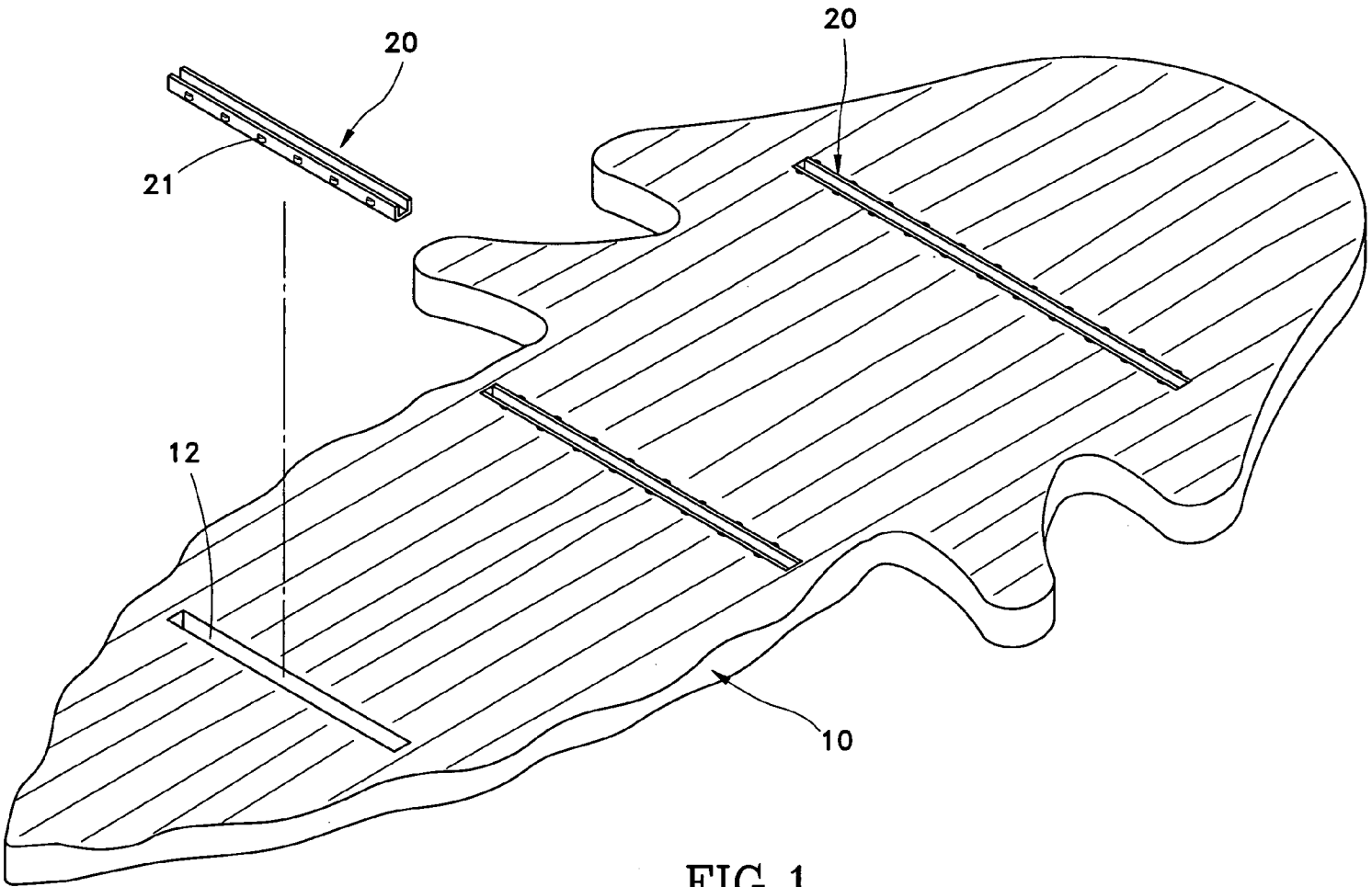
FIG. 1 is a perspective exploded view of a wooden fan blade according to the present invention.
Figure 2:
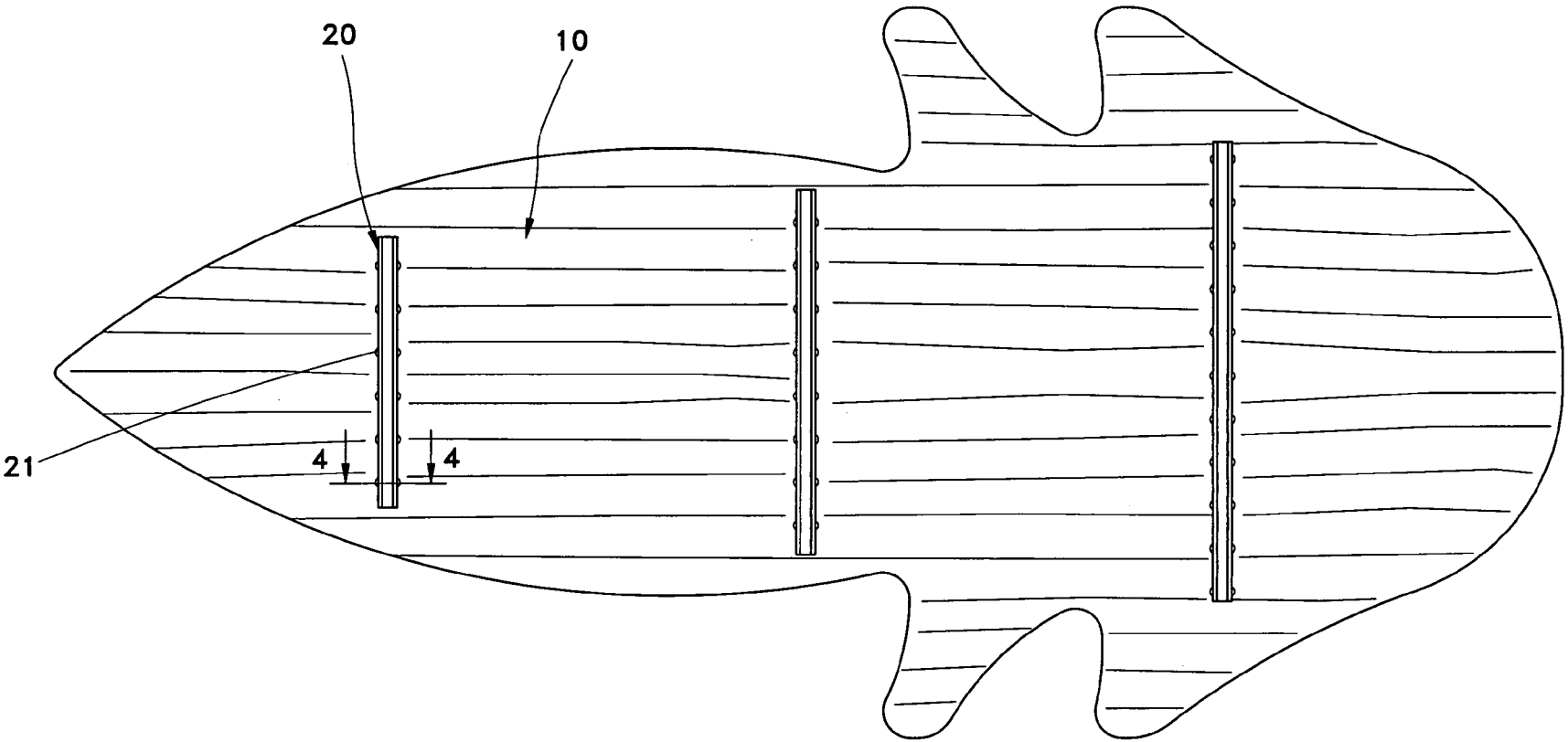
FIG. 2 is a bottom view of the wooden fan blade shown in FIG. 1.
Figure 3:
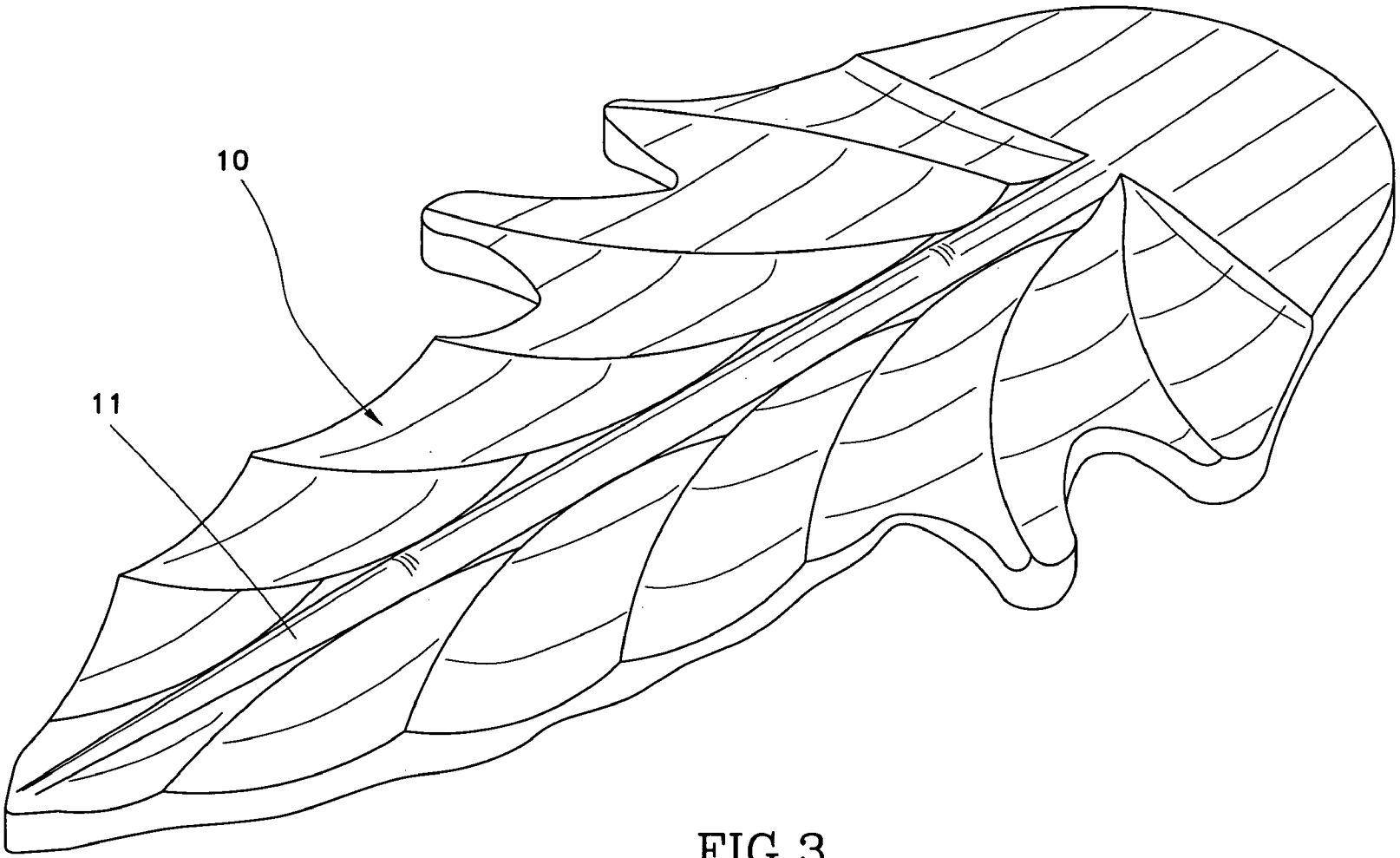
FIG. 3 is a top view of the wooden fan blade shown in FIG. 1.
Figure 4:
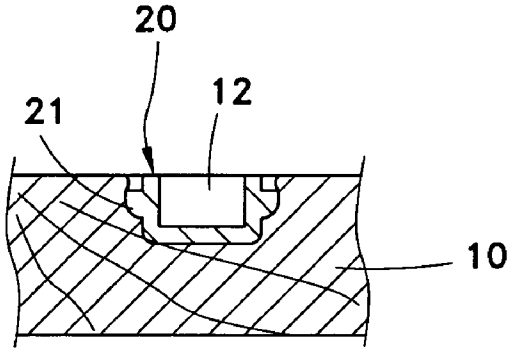
FIG. 4 is a sectional view taken along line 4—4 of FIG. 2.

Referring to FIGS. 1~4, a wooden fan blade in accordance with the present invention is shown comprised of a blade body 10 and three rib strips 20. The blade body 10 is a narrow, elongated flat member made of wood and shaped like a tree leaf. The fibers of the wooden material of the blade body 10 extend substantially in parallel to the longitudinal axis (major axis) of the blade body 10. The blade body 10 has a longitudinal reinforcing midrib 11 protruded from one side and shaped like the midrib of a real tree leaf, and three elongated grooves 12 transversely disposed at the other side across the extending direction of the fibers of the wooden material of the blade body 10.

The rib strips 20 are made of hard metal and shaped like a U-shaped channel bar, each having two sets of equally spaced raised portions 21 respectively arranged in line at each of the two opposite long sides along the longitudinal axis of the rib strip. The length and width of the rib strips 20 are approximately equal to the length and depth of the elongated grooves 12.

The rib strips 20 are respectively hammered into the elongated grooves 12, forcing the raised portions 21 of the rib strips 20 into engagement with the two opposite longitudinal sidewalls of each of the elongated grooves 12. Therefore, the rib strips 20 are firmly secured to the blade body 10 (see FIG. 4).

Because the rib strips 20 are respectively fastened to the elongated grooves 12 of the blade body 10, they protect the blade body 10 against bending in transverse direction (the minor axis direction). Further, the raised portions 21 of the rib strips 20 impart a retaining force to the fibers of the wooden material of the blade body 10 in transverse direction, preventing breaking of the blade body 10 between the fibers bundles.

Therefore, a wooden fan blade made according to the present invention is durable in use, not easy to deform or split.

Figure 5:
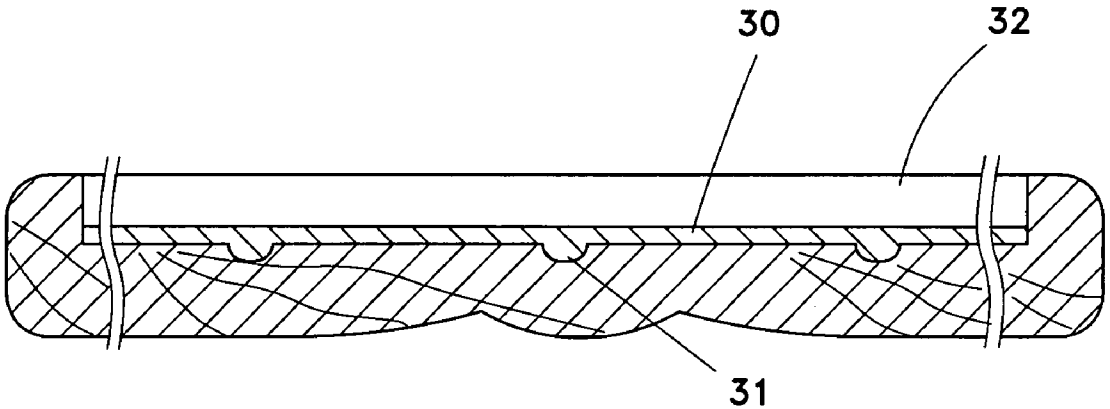
FIG. 5 is a sectional view of an alternate form of the wooden fan blade according to the present invention.

The invention is not limited to the use of the aforesaid rib strips. Any arrangement of rib strips that protects the blade body from curving inwards in the transverse direction (minor axis direction) and impart a transverse retaining force to the fibers of the wooden material of the blade body can be employed to the present invention. FIG. 5 shows an alternate form of the present invention (it is a cross-sectional view taken along one rib strip). This alternate form is substantially similar to the aforesaid embodiment with the exception that the raised portions 31 of the rib strips 30 are disposed at the bottom side corresponding to the bottom walls of the elongated grooves 32. When press-fitted the rib strips 30 into the elongated grooves 32, the raised portions 31 are respectively driven into the bottom walls of the elongated grooves 32.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wooden fan blade comprising:

a blade body made of a wooden plate having wooden fibers extended substantially in parallel to a longitudinal axis of said blade body, said blade body having an elongated groove transversely disposed at one side thereof across the extending direction of the wooden fibers of said wooden plate; and a rib strip fitted into said elongated groove and having a plurality of raised portions respectively forced into engagement with said blade body in said elongated groove.

2. The wooden fan blade as claimed in claim 1, wherein said rib strip has a U-shaped cross-section; the raised portions of said rib strip are respectively disposed at two opposite long sides of the rib strip and respectively forced into engagement with two opposite longitudinal sidewalls of said elongated groove.

3. The wooden fan blade as claimed in claim 1, wherein said rib strip has a U-shaped cross-section; the raised portions of said rib strip are disposed at a bottom side of the rib strip and respectively forced into engagement with a bottom wall of said elongated groove.

4. The wooden fan blade as claimed in claim 1, wherein said rib strip is made of metal.

5. The wooden fan blade as claimed in claim 1, wherein said blade body has a midrib longitudinally disposed at an opposite side thereof.

* * * * *